US005899374A

United States Patent [19]

Chen

[11] Patent Number: 5,899,374

[45] Date of Patent: May 4, 1999

[54] MAGAZINE SECURING ASSEMBLY FOR STAPLING MACHINES

[76] Inventor: Ton-Yi Chen, P.O. Box 82-144, Taipei, Taiwan

[21] Appl. No.: 08/995,716

[22] Filed: Dec. 22, 1997

[51] Int. Cl.[6] ..... B25C 1/04

[52] U.S. Cl. ..... 227/120

[58] Field of Search ..... 227/120, 135, 227/156, 109

[56] References Cited

U.S. PATENT DOCUMENTS

| | | | |
|---|---|---|---|
| 4,524,896 | 6/1985 | Morrell, Jr. | 227/120 |
| 4,607,777 | 8/1986 | Ebihara | 227/120 |
| 4,805,824 | 2/1989 | Erickson | 227/120 |
| 5,009,356 | 4/1991 | Chang | 227/120 |
| 5,505,362 | 4/1996 | Marks | 227/120 |
| 5,632,431 | 5/1997 | Lin | 227/120 |
| 5,730,350 | 3/1998 | Lin | 227/120 |

*Primary Examiner*—Scott A. Smith
*Attorney, Agent, or Firm*—A & J

[57] ABSTRACT

A magazine securing assembly including a body provided with a guide hole and a pin inserted in the guide hole, a magazine pivotally connected to the pin and having a trigger plate at a middle portion thereof, and a control switch disposed at one side of the body. The control switch projects from one side of the body and has one end urging against the pin, the one end having an insert groove for retaining the pin. By manipulating the control switch, the insert groove on the control switch can be controlled to engage or disengage from the pin so that the magazine can move up or down to allow clearing of jams in a convenient and safe way.

2 Claims, 4 Drawing Sheets

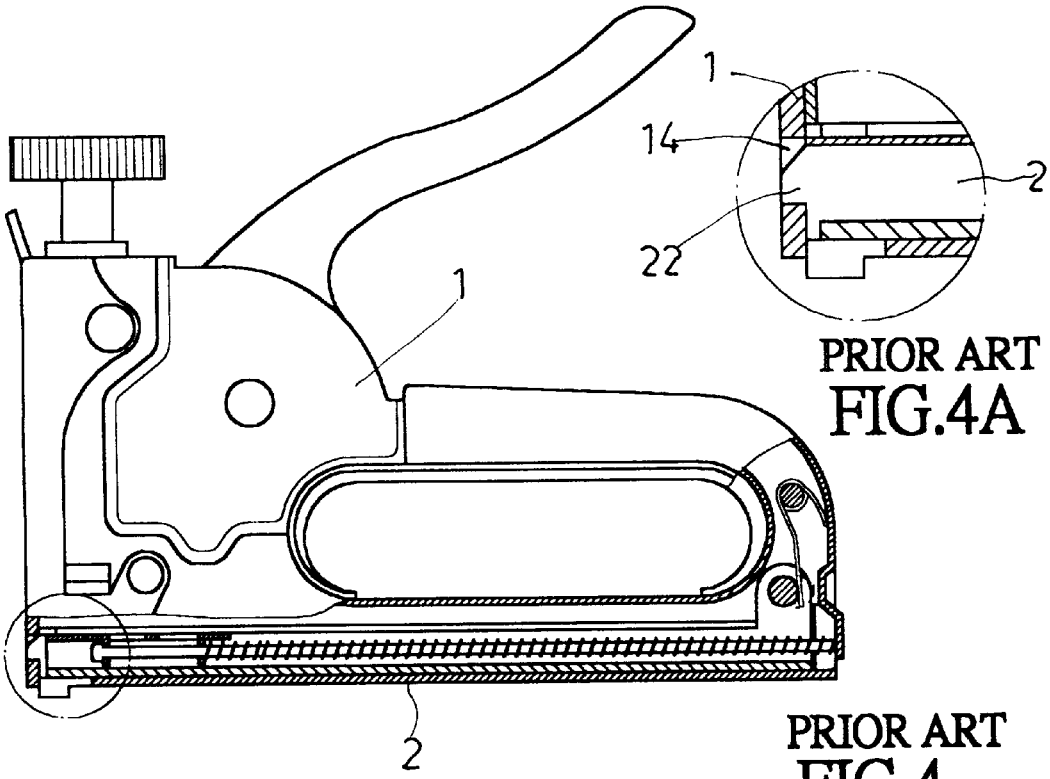
PRIOR ART
FIG.4A
PRIOR ART
FIG.4
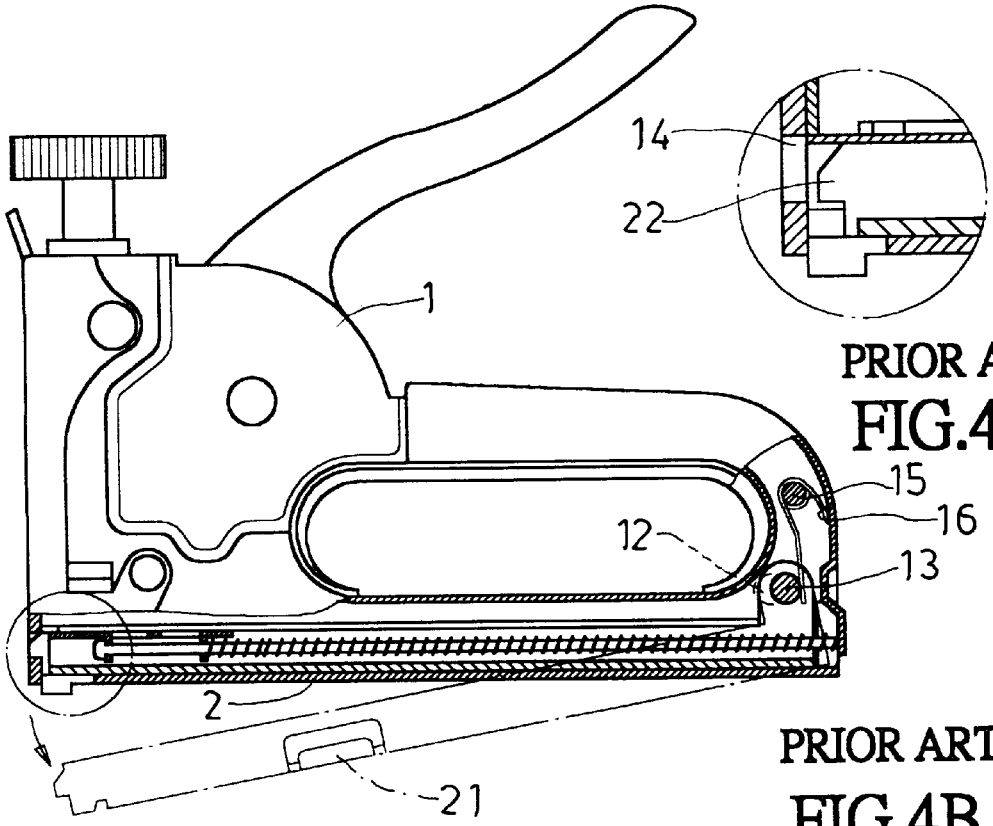
PRIOR ART
FIG.4C
PRIOR ART
FIG.4B

MAGAZINE SECURING ASSEMBLY FOR STAPLING MACHINES

BACKGROUND OF THE INVENTION

1. Field of the Invention

The present invention relates generally to a magazine securing assembly for stapling machines, and more particularly to a magazine securing assembly which is safe and convenient to operate.

2. Description of the Prior Art

FIGS. 4, 4A, 4B and 4C show a conventional stapling machine which essentially comprises a body 1 provided with an oval guide hole 12 which receives a pin 13, and a magazine 2 pivotally connected to the pin 13 of the body 1. The body 1 has a bar 15 fixedly disposed above the pin 13. The bar 15 has fitted thereon a torsion spring 16 which has one end urging against the pin 13. By pushing the magazine 2 to cause the pin 13 to displace towards the other end of the guide hole 12, an insert block 22 at a front end of the magazine 2 is disengaged from a retaining hole 14 of the body 1 so that it may displace downwardly with the point of connection as pivot. In addition, when the magazine 2 resets upwardly, the resilience of the torsion spring 16 causes the magazine 2 to be retained in the retaining hole 14 of the body 1 again. In actual use, such conventional stapling machines have the following drawbacks:

1. As the magazine 2 is secured by means of the torsion spring 16, the torsion spring 16 must have a certain elasticity in order to be able to urge against the magazine 2 on the body 1 to ensure smooth stapling operations. Hence it requires a relatively great force to push the magazine 2 rearwardly when trying to clear jamming.
2. The user may hurt his/her fingers when trying to pull the trigger plate 21 of the magazine 2 since it requires a larger force to push the magazine 2.

SUMMARY OF THE INVENTION

The present invention relates generally to a magazine securing assembly for stapling machines, and more particularly to a magazine securing assembly which is safe and convenient to operate.

A primary object of the present invention is to provide a magazine securing assembly for stapling machines in which a control switch disposed at one side of the body of the stapling machine has one end retaining a pin of the body so that the user may manipulate the control switch to cause the magazine to engage or disengage from the body. The user only needs to apply a little force to manipulate the control switch, making it easy to clear any jamming.

Another object of the present invention is to provide a magazine securing assembly for stapling machines in which the control switch may be pushed rearwardly so that pin may freely displace within a guide hole of the body to allow the magazine to move upwardly or downwardly with the point of connection as pivot, which is not only easy but also safe to operate.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIGS. 4, 4A, 4B and 4C are plan views and partially enlarged views of the prior art.

DETAILED DESCRIPTION OF THE PREFERRED EMBODIMENT

Figure 1:
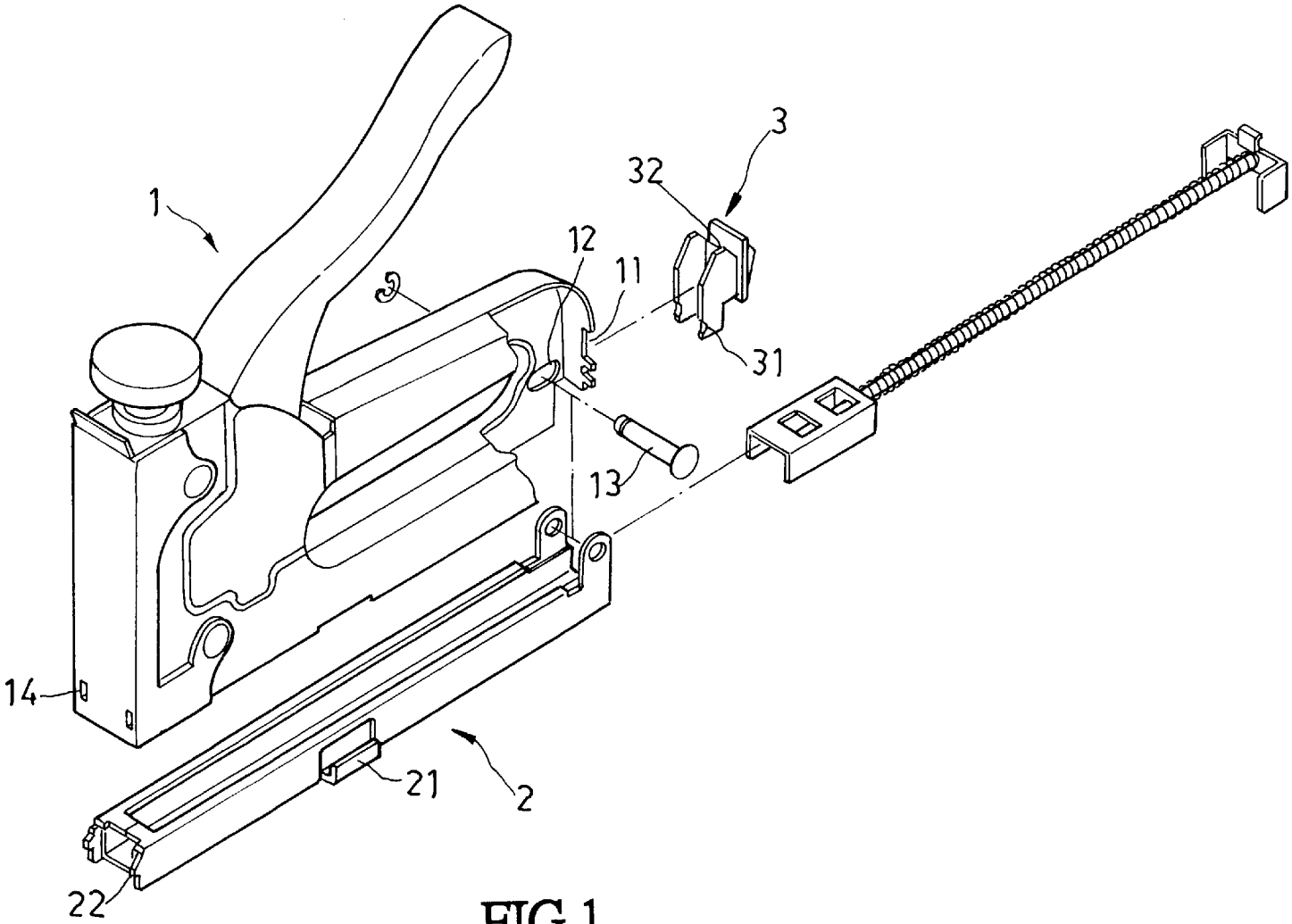
FIG. 1 is a perspective exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
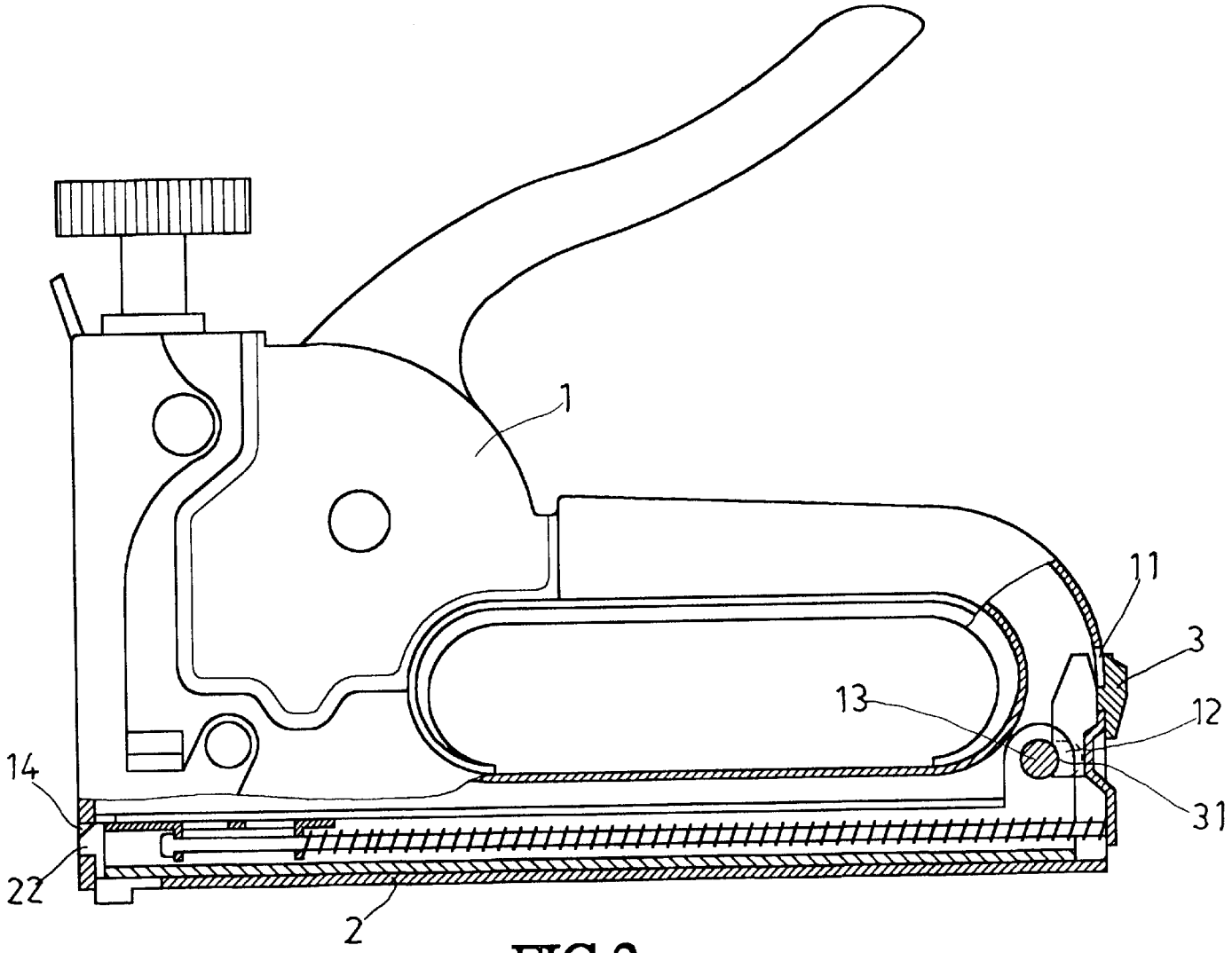
FIG. 2 is a plan view of the present invention.

With reference to FIGS. 1 and 2, the present invention comprises a body 1, a magazine 2 pivotally provided at a bottom end of the body 1, and a control switch 3 installed at one side of the body 1.

The body 1 includes a groove 11 at one end that may just retain the control switch 3. The body 1 is further provided with an oval guide hole 12 for receiving a pin 13, and a retaining hole 14 at the other end at a lower portion.

The magazine 2 is pivotally mounted on the pin 13 and has a trigger plate 21 at a middle portion thereof. The magazine 2 further has an insert block 22 at a front end which may just engage the retaining hole 14 of the body 1.

The control switch 3 has one side projecting from the body 1, with the other side urging against the pin 13. The control switch 3 has a recessed retaining portion 32 at a middle portion for retaining the body 1. Furthermore, that side of the control switch 3 urging against the pin 13 is provided with an insert groove 31 that may just retain the pin 13.

By manipulating the control switch 3, the insert groove 31 thereof may disengage or engage the pin 13 so that the magazine 2 may displace upwardly and downwardly using the point of connection as pivot, allowing jam clearing in a convenient and safe way.

Figure 3B:
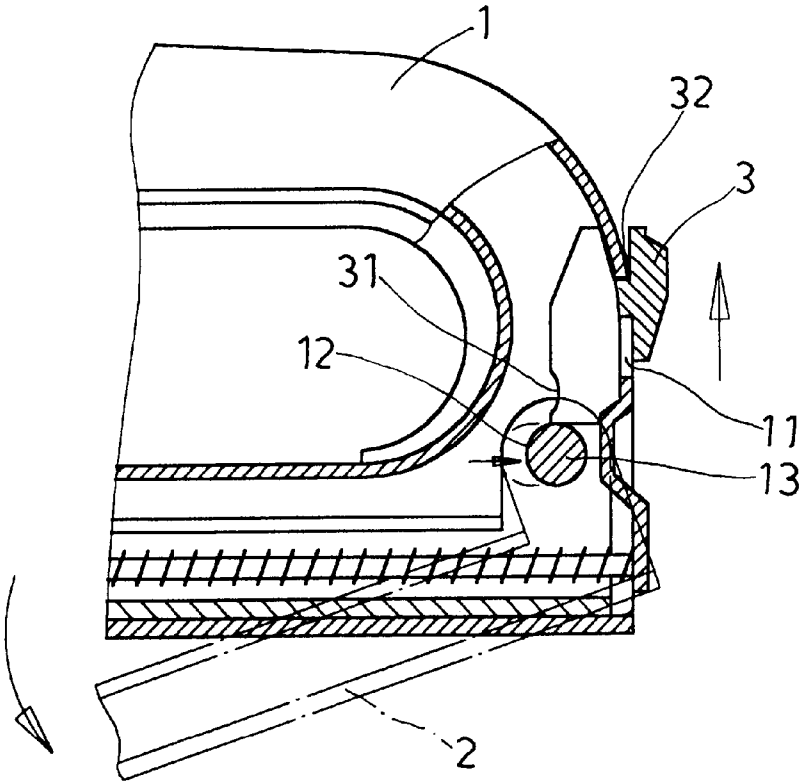
FIGS. 3A and 3B are plan views illustrating operation of the present invention.
Figure 3A:
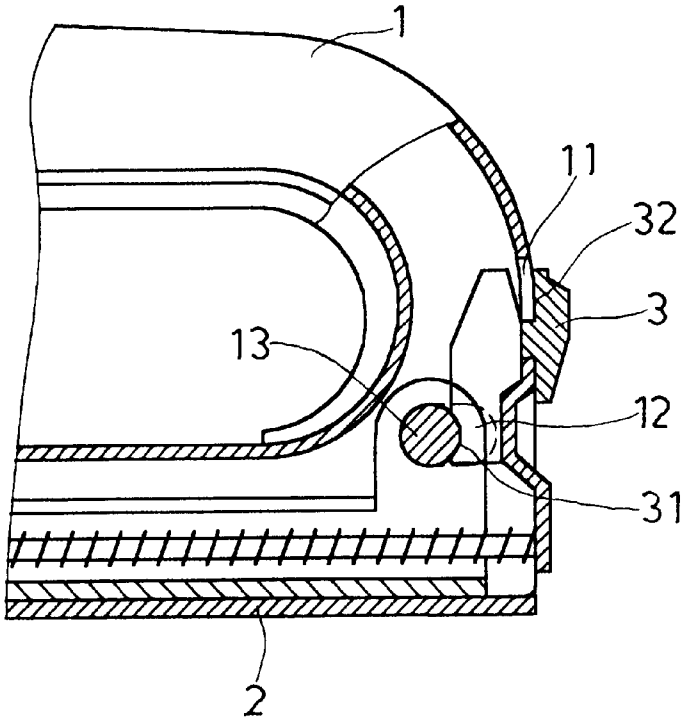

When the stapling machine is in a striking state, as shown in FIGS. 3A and 3B, the control switch 3 is located at the bottom end of the groove 11 of the body 1, and the insert groove 31 of the control switch 3 urges the pin 13 to the left end of the guide hole 12, so that the pin 13 is retained and positioned in the insert groove 31. At the same time, the insert block 22 at the front end of the magazine 2 is retained in the retaining hole 14 of the body 1, securing the magazine 2 on the body 1 (see FIG. 3A). In addition, by pulling the control switch 3 upwardly, so that the pin 13 disengages from the insert groove 31, the pin 13 may freely displace within the guide hole 12. At this point, by pushing the trigger plate 21 to the rear to bring the magazine 2 and the pin 13 to the right end of the guide hole 12, the insert block 22 of the magazine will disengage from the retaining hole 14 of the body 1 so that the magazine 2 may turn downwardly with the point of connection as pivot (see FIG. 3B) and allow jam clearing.

In summary, the present invention has the following advantages:

1. By manipulating the control switch 3 that projects from the body 1 and engages the pin 13, the user can easily control the magazine 2 to engage with or disengage from the body 1. The user only needs to apply a little force to manipulate the control switch.
2. As the pin 13 can freely displace within the guide hole 12 after the control switch 3 is pulled upwardly, the magazine 2 can be turned upwardly or downwardly with the point of connection as fulcrum. Such operation is not only easy but also safe.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A magazine securing assembly for stapling machines, comprising a body provided with a guide hole and a pin received in said guide hole, a magazine having a trigger plate at a middle portion thereof, and a control switch provided at one end of said body, wherein said control switch has one end projecting from said body, with an opposite end urging against said pin, and said control switch is provided with a recessed retaining portion at a middle portion thereof for retaining said body.

2. The magazine securing assembly as claimed in claim 1, wherein the opposite end of said control switch which urges against said pin of said body is provided with an insert groove for retaining said pin.

* * * * *